US007864155B2

(12) United States Patent
Kawaguchi

(10) Patent No.: US 7,864,155 B2
(45) Date of Patent: Jan. 4, 2011

(54) DISPLAY CONTROL CIRCUIT, DISPLAY CONTROL METHOD, AND LIQUID CRYSTAL DISPLAY DEVICE

(75) Inventor: Seiji Kawaguchi, Hirakata (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 1229 days.

(21) Appl. No.: 11/224,133

(22) Filed: Sep. 13, 2005

(65) Prior Publication Data

US 2006/0055661 A1 Mar. 16, 2006

(30) Foreign Application Priority Data

Sep. 15, 2004 (JP) ..... 2004-268633

(51) Int. Cl.
*G09G 3/36* (2006.01)

(52) U.S. Cl. ..... 345/102

(58) Field of Classification Search ..... 345/38, 345/98, 102, 204
See application file for complete search history.

(56) References Cited

U.S. PATENT DOCUMENTS

| | | | | |
|---|---|---|---|---|
| 2003/0038770 | A1 * | 2/2003 | Lee et al. | 345/102 |
| 2004/0001054 | A1 * | 1/2004 | Nitta et al. | 345/204 |
| 2004/0056825 | A1 * | 3/2004 | Min et al. | 345/38 |
| 2004/0113900 | A1 * | 6/2004 | Abe et al. | 345/204 |
| 2005/0078080 | A1 * | 4/2005 | Kang et al. | 345/102 |

FOREIGN PATENT DOCUMENTS

| | | |
|---|---|---|
| JP | 11-109921 | 4/1999 |
| JP | 2001-183622 | 7/2001 |

(Continued)

OTHER PUBLICATIONS

U.S. Appl. No. 11/441,091, filed May 26, 2006, Kawaguchi.

(Continued)

*Primary Examiner*—Chanh Nguyen
*Assistant Examiner*—Sanghyuk Park
(74) *Attorney, Agent, or Firm*—Oblon, Spivak, McClelland, Maier & Neustadt, L.L.P.

(57) ABSTRACT

A display control circuit includes a vertical timing control circuit that generates first and second start signals, a panel driving unit that sequentially drives a plurality of OCB liquid crystal pixels in units of one row under the control of the first start signal to hold pixel voltages for gradation display in the pixels PX of the driven row, and that sequentially drives the pixels in units of at least one row under the control of the second start signal to hold pixel voltages for black insertion in the pixels of the driven row, and a light source driving unit that drives a plurality of backlight sources arranged substantially in parallel to the rows of pixels. In particular, the light source driving unit is configured to start, in synchronism with the first start signal, an operation for sequentially blinking the backlight sources with a predetermined duty ratio. The predetermined duty ratio is determined in accordance with a dimmer signal from outside such that the predetermined duty ratio, at a maximum value thereof, is not greater than a ratio of a holding period of the pixel voltage for gradation display to a sum of the holding period of the pixel voltage for gradation display and a holding period of the pixel voltage for black insertion.

3 Claims, 7 Drawing Sheets

FOREIGN PATENT DOCUMENTS

| | | |
|---|---|---|
| JP | 2002-202491 | 7/2002 |
| JP | 2003-44007 | 2/2003 |
| JP | 2003-280600 | 10/2003 |
| JP | 2003-295156 | 10/2003 |
| JP | 2004-157373 | 6/2004 |

OTHER PUBLICATIONS

U.S. Appl. No. 11/217,462, filed Sep. 2, 2005, Kawaguchi et al.

* cited by examiner

TB

| Conversion table for black insertion ratio of 20% | |
|---|---|
| Input value | Output value |
| 100% | 70% |
| 80% | 55% |
| 60% | 40% |
| 40% | 25% |

FIG. 7

TB

| Conversion table for black insertion ratio of 50% | |
|---|---|
| Input value | Output value |
| 100% | 50% |
| 80% | 40% |
| 60% | 30% |
| 40% | 20% |

FIG. 8

DISPLAY CONTROL CIRCUIT, DISPLAY CONTROL METHOD, AND LIQUID CRYSTAL DISPLAY DEVICE

CROSS-REFERENCE TO RELATED APPLICATIONS

This application is based upon and claims the benefit of priority from prior Japanese Patent Application No. 2004-268633, filed Sep. 15, 2004, the entire contents of which are incorporated herein by reference.

BACKGROUND OF THE INVENTION

1. Field of the Invention

The present invention relates to a display control circuit, a display control method and a liquid crystal display device, which are suitable for moving-image display using a liquid crystal display panel of, e.g. an OCB (Optically Compensated Birefringence).

2. Description of the Related Art

Flat-panel display devices, which are typified by liquid crystal display devices, have widely been used as display devices for computers, car navigation systems, TV receivers, etc.

The liquid crystal display device generally includes a liquid crystal display panel including a matrix array of liquid crystal pixels, a backlight that illuminates the liquid crystal display panel, and a display panel control circuit that controls the display panel and the backlight. The liquid crystal display panel is configured such that a liquid crystal layer is held between an array substrate and a counter substrate.

The array substrate includes a plurality of pixel electrodes that are arrayed substantially in a matrix, a plurality of gate lines that are arranged along rows of the pixel electrodes, a plurality of source lines that are arranged along columns of the pixel electrodes, and a plurality of switching elements that are disposed near intersections between the gate lines and the source lines. Each of the switching elements is formed of, e.g. a thin-film transistor (TFT). When one associated gate line is driven, the TFT is turned on to apply a potential of one associated source line to one associated pixel electrode. The counter substrate is provided with a common electrode that is opposed to the pixel electrodes arrayed on the array substrate. Each pair of pixel electrode and common electrode, together with a pixel area that is a part of the liquid crystal layer situated between these electrodes, constitute a pixel. In the pixel area, the alignment of liquid crystal molecules is controlled by an electric field that is created between the pixel electrode and the common electrode. The display control circuit includes a gate driver that drives the gate lines, a source driver that drives the source lines, and a controller circuit that controls the gate driver, the source driver and the backlight.

In the case where the liquid crystal display device is used for a TV receiver that principally displays a moving image, it is proposed to use a liquid crystal display panel of an OCB-mode, in which liquid crystal molecules exhibit good responsivity (see Jpn. Pat. Appln. KOKAI Publication No. 2002-202491). In this liquid crystal display panel, the liquid crystal molecules are aligned in a substantially horizontal splay alignment prior to supply of power by alignment films that are provided on the pixel electrode and common electrode and are rubbed in directions parallel to each other. In the liquid crystal display panel, a display operation is performed after the splay alignment of the liquid crystal molecules is transferred to a bend alignment by a relatively strong electric field that is applied in an initializing process following supply of power.

The reason why the liquid crystal molecules are aligned in the splay alignment before supply of power is that the splay alignment is more stable than the bend alignment in terms of energy in a state where the liquid crystal driving voltage is not applied. As a characteristic of the liquid crystal molecules, the bend alignment tends to be inverse-transferred to the splay alignment if a state where no voltage is applied or a state where a voltage lower than a level at which the energy of splay alignment is balanced with the energy of bend alignment is applied, continues for a long time. The viewing angle characteristic of the splay alignment significantly differs from that of the bend alignment. Thus, a normal display is not attained in this splay alignment.

In a conventional driving method that prevents the inverse transfer from the bend alignment to the splay alignment, a high voltage is applied to the liquid crystal molecules in a part of a frame period for a display of a 1-frame image, for example. This high voltage corresponds to a pixel voltage for black display in an OCB-mode liquid crystal display panel, which is a normally-white type, so this driving method is called "black insertion driving."

A pixel voltage for black insertion and a pixel voltage for gradation display are applied to all liquid crystal pixels on a row-by-row basis in one frame period, i.e. one vertical scanning period (V). The ratio of a holding period of the pixel voltage for black insertion to a holding period of the pixel voltage for gradation display is a black insertion ratio. In a case where each gate line is driven for black insertion in a half of one horizontal scanning period (H), i.e. H/2 period, and is driven for gradation display in a subsequent H/2 period, the vertical scanning speed becomes twice higher than in the case where black insertion is not executed. Since the value of the pixel voltage for black insertion is common to all pixels, it is possible to drive, for instance, two gate lines together as a set. In a case where two gate lines of each set are driven together for black insertion in a 2H/3 period, and are sequentially driven for gradation display in a 4H/3 period (2H/3 for each of two gate lines), the vertical scanning speed becomes 1.5 times higher than in the case where black insertion is not executed.

In the meantime, since the liquid crystal display panel is a hold-type display device that holds a display state until updating of image data, it is difficult to smoothly display the motion of an object, owing to the effect of retinal persistence occurring on a viewer's vision in moving-image display. In the black insertion driving, the retinal persistence is cleared by a discrete pseudo-impulse response waveform of pixel luminance. Thus, the black insertion driving is effective in improving the moving-image visibility, which lowers due to the viewer's vision. However, the black display state that is obtained by the black insertion driving is not the perfect black, which would be obtained, for example, when the backlight is turned off. Under the circumstances, it is considered to obtain good moving-image visibility by making use of a blinking driving in which the backlight is blinked. A black insertion ratio for preventing inverse transfer is about 25%. As the black insertion ratio is increased, the moving-image visibility is improved accordingly.

In the case of blink-driving the backlight, the duty ratio of the backlight, that is, the ratio of a turn-on period to a blinking cycle that is normally one vertical scanning period, can be used in order to adjust the brightness of the entire liquid crystal display panel on the basis of a dimmer signal that is supplied from an external signal source. If the duty ratio of the backlight is 100% that means continuous turn-on, it is not expectable that the moving-image visibility is improved by the blink-driving. If the duty ratio is set at, e.g. 70% or 50%, it is possible to decrease the brightness of the entire liquid crystal display panel, while improving the moving-image visibility.

However, even if the duty ratio of the backlight is varied by the dimmer signal, the backlight is turned off during the holding period of the pixel voltage for gradation display or turned on during the holding period of the pixel voltage for black insertion, owing to the effect of the black insertion ratio and black insertion timing on the liquid crystal display panel side, and the brightness of the liquid crystal display panel does not linearly vary in relation to the variation in duty ratio of the backlight. In order to solve this problem, it may be possible to non-linearly vary a dimmer signal from an external signal source. In this case, however, the provision of the external signal source is a burden on the user, and a very complicated control is required.

BRIEF SUMMARY OF THE INVENTION

The object of the present invention is to provide a display control circuit, a display control method and a liquid crystal display device, which can vary the brightness of a display panel in a linear fashion in relation to a dimmer signal from outside in blink-driving of a backlight.

According to a first aspect of the present invention, there is provided a display control circuit for a display panel in which a plurality of liquid crystal pixels are arrayed substantially in a matrix, comprising: a timing control circuit that generates a start signal for gradation display and a start signal for non-gradation display; a panel driving unit that sequentially drives the liquid crystal pixels in units of one row under the control of the start signal for gradation display to hold pixel voltages for gradation display in the liquid crystal pixels of the driven row, and that sequentially drives the liquid crystal pixels in units of at least one row under the control of the start signal for non-gradation display to hold pixel voltages for non-gradation display in the liquid crystal pixels of the driven row; and a light source driving unit that drives a plurality of backlight sources arranged substantially in parallel to the rows of liquid crystal pixels, wherein the light source driving unit is configured to start, in synchronism with the start signal for gradation display, an operation for sequentially blinking the backlight sources with a predetermined duty ratio, and the predetermined duty ratio is determined in accordance with a dimmer signal from outside such that the predetermined duty ratio, at a maximum value thereof, is not greater than a ratio of a holding period of the pixel voltage for gradation display to a sum of the holding period of the pixel voltage for gradation display and a holding period of the pixel voltage for non-gradation display.

According to a second aspect of the present invention, there is provided a display control method for a display panel in which a plurality of liquid crystal pixels are arrayed substantially in a matrix, comprising: generating a start signal for gradation display and a start signal for non-gradation display; sequentially driving the liquid crystal pixels in units of one row under the control of the start signal for gradation display to hold pixel voltages for gradation display in the liquid crystal pixels of the driven row, and sequentially driving the liquid crystal pixels in units of at least one row under the control of the start signal for non-gradation display to hold pixel voltages for non-gradation display in the liquid crystal pixels of the driven row; and starting, in synchronism with the start signal for gradation display, an operation for sequentially blinking a plurality of backlight sources arranged substantially in parallel to the rows of liquid crystal pixels with a predetermined duty ratio, the predetermined duty ratio being determined in accordance with a dimmer signal from outside such that the predetermined duty ratio, at a maximum value thereof, is not greater than a ratio of a holding period of the pixel voltage for gradation display to a sum of the holding period of the pixel voltage for gradation display and a holding period of the pixel voltage for non-gradation display.

According to a third aspect of the present invention, there is provided a liquid crystal display device comprising: a display panel in which a plurality of liquid crystal pixels are arrayed substantially in a matrix; a timing control circuit that generates a start signal for gradation display and a start signal for non-gradation display; a panel driving unit that sequentially drives the liquid crystal pixels in units of one row under the control of the start signal for gradation display to hold pixel voltages for gradation display in the liquid crystal pixels of the driven row, and that sequentially drives the liquid crystal pixels in units of at least one row under the control of the start signal for non-gradation display to hold pixel voltages for non-gradation display in the liquid crystal pixels of the driven row; and a light source driving unit that drives a plurality of backlight sources arranged substantially in parallel to the rows of liquid crystal pixels, wherein the light source driving unit is configured to start, in synchronism with the start signal for gradation display, an operation for sequentially blinking the backlight sources with a predetermined duty ratio, and the predetermined duty ratio is determined in accordance with a dimmer signal from outside such that the predetermined duty ratio, at a maximum value thereof, is not greater than a ratio of a holding period of the pixel voltage for gradation display to a sum of the holding period of the pixel voltage for gradation display and a holding period of the pixel voltage for non-gradation display.

According to a fourth aspect of the present invention, there is provided a liquid crystal display device comprising: a display panel in which a plurality of liquid crystal pixels are arrayed substantially in a matrix, and an image is displayed by a repetitive operation of sequentially driving the liquid crystal pixels in units of one row at a predetermined timing to write and hold pixel voltages for gradation display in the liquid crystal pixels, and sequentially driving the rows of liquid crystal pixels at a timing different from the predetermined timing to write and hold pixel voltages for non-gradation display in the liquid crystal pixels; and a light source that illuminates the display panel and is blinked with a duty ratio variably determined by a dimmer signal from outside, the dimmer signal being subjected to a conversion which is effected to determine the duty ratio according to a ratio of a holding period of the pixel voltage for gradation display to a sum of the holding period of the pixel voltage for gradation display and a holding period of the pixel voltage for non-gradation display and to drive the light source based on a result of conversion.

In the display control circuit, the display control method and the liquid crystal display device, it is possible to vary the turn-on period of each backlight source within the range of the holding period of the pixel voltage for gradation display in the associated liquid crystal pixel. This prevents the following problem: an illumination period, which is necessary for obtaining a target brightness, cannot be secured due to turn-off of the backlight source during the holding period of the pixel voltage for gradation display, or a non-illumination period, which is necessary for obtaining the target brightness, cannot be secured due to turn-on of the backlight source during the holding period of the pixel voltage for non-gradation display. Hence, in the blink-driving of the backlight, the brightness of the display panel can be varied in a linear fashion in relation to the dimmer signal from the outside.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 7 shows an example of a conversion table for a black insertion ratio of 20%, which is incorporated in a dimmer signal converting circuit shown in FIG. 1;

FIG. 8 shows an example of a conversion table for a black insertion ratio of 50%, which is incorporated in the dimmer signal converting circuit shown in FIG. 1.

DETAILED DESCRIPTION OF THE INVENTION

Figure 1:
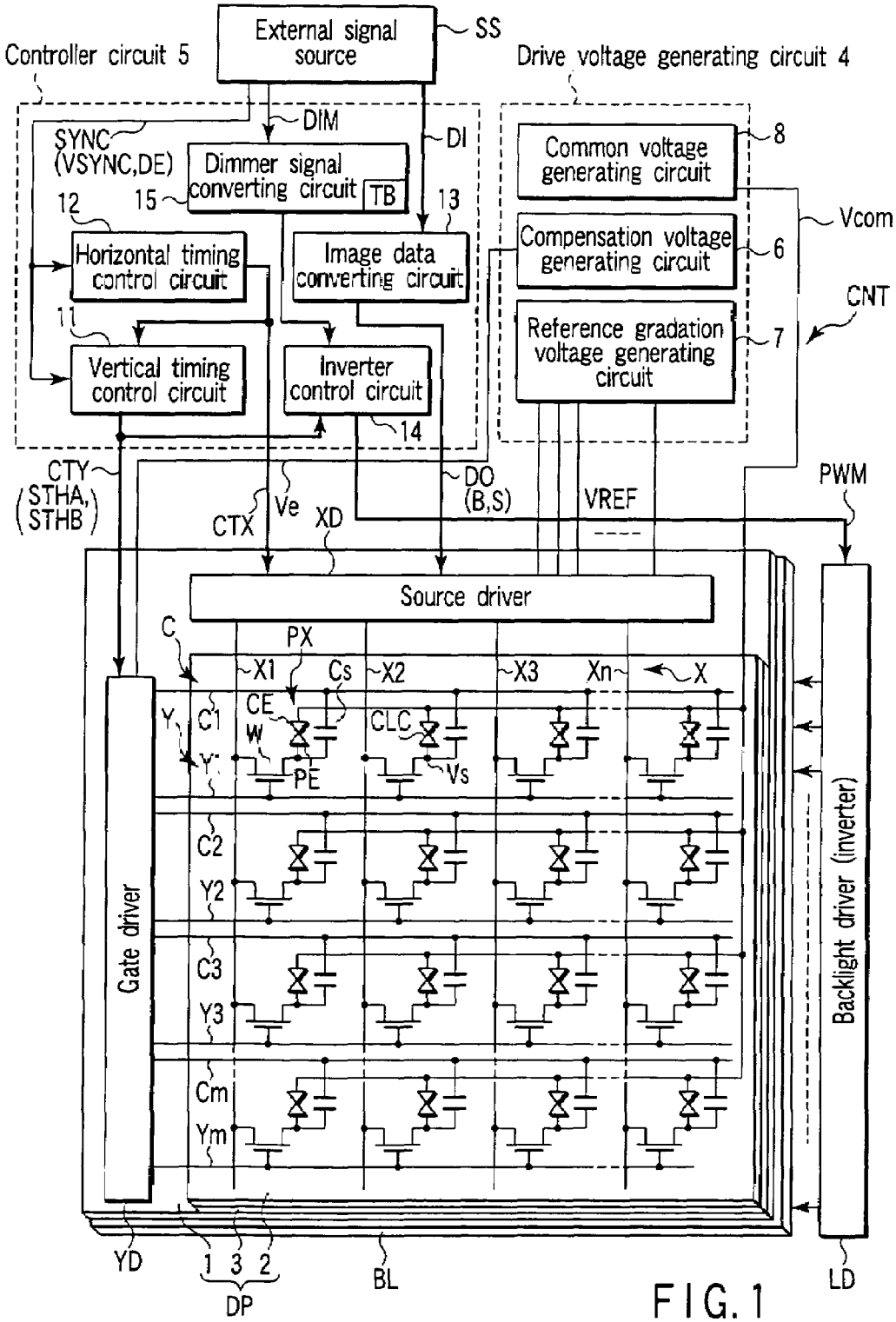
FIG. 1 schematically shows the circuit structure of a liquid crystal display device according to an embodiment of the present invention.

A liquid crystal display device according to an embodiment of the present invention will now be described with reference to the accompanying drawings. FIG. 1 schematically shows the circuit configuration of the liquid crystal display device. The liquid crystal display device comprises a liquid crystal display panel DP, a backlight BL that illuminates the display panel DP, and a display control circuit CNT that controls the display panel DP and backlight BL. The liquid crystal display panel DP is configured such that a liquid crystal layer 3 is held between an array substrate 1 and a counter substrate 2, which are a pair of electrode substrates. The liquid crystal layer 3 contains a liquid crystal material in which the alignment state of liquid crystal molecules is transferred in advance from a splay alignment to a bend alignment that is usable for a display operation. Upon supply of power, the display panel control circuit CNT executes an initializing process that transfers the splay alignment of the liquid crystal molecules to the bend alignment with a relatively strong electric field. After the initializing process, the transmittance of the liquid crystal display panel DP can be set at a value corresponding to a liquid crystal driving voltage that is applied from the array substrate 1 and counter substrate 2 to the liquid crystal layer 3. The display control circuit CNT controls the liquid crystal display panel DP so as to execute non-gradation display with a desired ratio to gradation display. The gradation display is executed using a liquid crystal driving voltage that varies in accordance with image information, while the non-gradation display is executed using a fixed liquid crystal driving voltage. In this case, the fixed liquid crystal driving voltage is a voltage that prevents inverse transfer from the bend alignment to the splay alignment. In the case where the liquid crystal display panel DP is, e.g. of a normally-white mode, black is displayed when the voltage for preventing the inverse transfer is applied as the fixed liquid crystal driving voltage to the liquid crystal layer 3. Specifically, black insertion is cyclically executed, relative to gradation display. In the description below, the "black insertion" is used as an example of the non-gradation display.

The array substrate 1 includes a plurality of pixel electrodes PE that are arrayed substantially in a matrix on a transparent insulating substrate of, e.g. glass; a plurality of gate lines Y (Y1 to Ym) that are arranged along rows of the pixel electrodes PE; a plurality of source lines X (X1 to Xn) that are arranged along columns of the pixel electrodes PE; and a plurality of pixel switching elements W that are disposed near intersections between the gate lines Y and source lines X, each pixel switching element W being rendered conductive between the associated source line X and associated pixel electrode PE when driven via the associated gate line Y. Each of the pixel switching elements W is composed of, e.g. a thin-film transistor. The thin-film transistor has a gate connected to the associated gate line Y, and a source-drain path connected between the associated source line X and pixel electrode PE.

The counter substrate 2 includes a color filter, which is disposed on a transparent insulating substrate of, e.g. glass and comprises red, green and blue color layers, and a common electrode CE that is disposed on the color filter so as to be opposed to the pixel electrodes PE. Each pixel electrode PE and the common electrode CE are formed of a transparent electrode material such as ITO, and are coated with alignment films that are subjected to rubbing treatment in directions parallel to each other. The pixel electrode PE and common electrode CE constitute an OCB liquid crystal pixel PX, together with a pixel area, which is a part of the liquid crystal layer 3 and in which the alignment of liquid crystal molecules is controlled according to an electric field between the pixel electrode PE and common electrode CE.

Each of the liquid crystal pixels PX has a liquid crystal capacitance CLC between the associated pixel electrode PE and the common electrode CE. Each of storage capacitance lines C1 to Cm are capacitively coupled to the pixel electrodes PE of the liquid crystal pixels PX on the associated row to constitute a storage capacitance Cs. The storage capacitance Cs has a sufficiently high capacitance value, relative to a parasitic capacitance of the pixel switching element W.

The display control circuit CNT includes a gate driver YD that sequentially drives the gate lines Y1 to Ym to turn on the switching elements W on a row-by-row basis; a source driver XD that outputs pixel voltages Vs to the source lines X1 to Xn in a time period in which the switching elements W on each row are driven by the associated gate line Y; a backlight driver LD that drives the backlight BL; a drive voltage generating circuit 4 that generates voltages for driving the display panel DP; and a controller circuit 5 that controls the gate driver YD, source driver XD and backlight driver (inverter) LD.

The drive voltage generating circuit 4 includes a compensation voltage generating circuit 6 that generates a compensation voltage Ve, which is applied to the storage capacitance line C via the gate driver YD; a reference gradation voltage generating circuit 7 that generates a predetermined number of reference gradation voltages VREF, which are to be used by the source driver XD; and a common voltage generating circuit 8 that generates a common voltage Vcom, which is applied to the counter electrode CT. The controller circuit 5 includes a vertical timing control circuit 11 that generates a control signal CTY for the gate driver YD on the basis of a sync signal SYNC (VSYNC, DE), which is input from an external signal source SS; a horizontal timing control circuit 12 that generates a control signal CTX for the source driver XD on the basis of the sync signal SYNC (VSYNC, DE), which is input from the external signal source SS; an image data converting circuit 13 that executes, e.g. 2× (double-speed) black inserting conversion for image data that is input from the external signal source SS in association with the pixels PX; and an inverter control circuit 14 that controls the backlight driver (inverter) LD on the basis of the control signal CTX that is output from the vertical timing control circuit 11. The image data comprise a plurality of pixel data DI for the liquid crystal pixels PX, and the image data are updated in every one frame period (vertical scan period V). The control signal CTY is supplied to the gate driver YD. The control signal CTX is supplied to the source driver XD, along with pixel data DO that is obtained as a conversion result from the image data converting circuit 13. The control signal CTY is used by the gate driver YD to sequentially drive the gate lines Y, as described above. The control signal CTX is used to assign the pixel data DO, which are obtained as a conversion result of the image data converting circuit 13 in units of liquid crystal pixels PX of one row and are serially output, to the respective source lines X, and also used to designate the output polarity.

The gate driver YD and source driver XD are constructed, for example, using shift register circuits, in order to select the gate lines Y and source lines X. In this case, the control signal CTY includes a first start signal (gradation display start signal) STHA that controls a gradation display start timing; a second start signal (black-insertion start signal) STHB that controls a black-insertion start timing; a clock signal that is used to shift the start signals STHA and STHB in the shift register circuit; and an output enable signal that controls output of driving signals to the gate lines Y1 to Ym, which are selected sequentially in units of a predetermined number or selected at a time by the shift register circuit in accordance with the storage positions where the start signals STHA and STHB are located. On the other hand, the control signal CTX includes a start signal that controls the capture start timing of pixel data of one row; a clock signal that is used to shift the start signal in the shift register circuit; a load signal that controls the parallel-output timing of pixel data DO of one row, which are captured for the source lines X1 to Xn that are selected one by one by the shift register circuit in accordance with the storage position where the start signal is located; and a polarity signal that controls the signal polarity of pixel voltages Vs corresponding to the pixel data.

Under the control of the control signal CTY, the gate driver YD sequentially selects the gate lines Y1 to Ym for gradation display and black insertion in one frame period, and supplies to the selected gate lines Y ON-voltages as driving signals for turning on the pixel switching elements W on each row for only one horizontal scanning period H. In the case where the image data converting circuit 13 executes double-speed black inserting conversion, the input pixel data DI for one row is converted in every 1H to pixel data B for black insertion for one row and pixel data S for gradation display for one row, which become output pixel data DO. The gradation display pixel data S has the same gradation value as the pixel data DI, and the black-insertion pixel data B has a gradation value for black display. Each of the black-insertion pixel data B for one row and the gradation display pixel data S for one row is serially output from the image data converting circuit 13 in an H/2 period. Referring to the predetermined number of reference gradation voltages VREF that are supplied from the reference gradation voltage generating circuit 7, the source driver XD converts the pixel data B and S to pixel voltages Vs, and outputs the pixel voltages Vs to the plural source lines X1 to Xn in parallel.

The pixel voltage Vs is a voltage that is applied to the pixel electrode PE relative to a common voltage Vcom of the common electrode CE. A difference voltage between the pixel voltage Vs and common voltage Vcom becomes a liquid crystal driving voltage for one pixel PX. The polarity of the pixel voltage Vs is reversed, relative to the common voltage Vcom, so as to execute, e.g. frame-reversal driving and line-reversal driving. In the case where black insertion driving is executed at a 2× vertical scan speed, the polarity of the pixel voltage Vs is reversed, relative to the common voltage Vcom, so as to execute, e.g. line-reversal driving and frame-reversal driving (1H1V reversal driving). When the switching elements W for one row are rendered non-conductive, the compensation voltage Ve is applied via the gate driver YD to the storage capacitance line C corresponding to the gate line Y that is connected to these switching elements. The compensation voltage Ve is used in order to compensate a variation in pixel voltages Vs, which occurs in the pixels PX of one row due to the parasitic capacitances of the switching elements W.

Assume now that the gate driver YD drives the gate line Y1, for instance, by an ON-voltage, and turns on all pixel switching elements W that are connected to the gate line Y1. In this case, the pixel voltages Vs on the source lines X1 to Xn are applied via the pixel switching elements W to the associated pixel electrodes PE and to terminals at one end of the associated storage capacitances Cs. In addition, the gate driver YD outputs the compensation voltage Ve from the compensation voltage generating circuit 6 to the storage capacitance line C1 that corresponds to the gate line Y1. Immediately after turning on all pixel switching elements W, which are connected to the gate line Y1, for one horizontal scan period, the gate driver YD outputs to the gate line Y1 an OFF-voltage that turns off the pixel switching elements W. When the pixel switching elements W are turned off, the compensation voltage Ve reduces the amount of charge that is to be extracted from the pixel electrodes PE due to the parasitic capacitances of the pixel switching elements W, thereby substantially canceling a variation in pixel voltage Vs, that is, a field-through voltage $\Delta Vp$.

Figure 2:
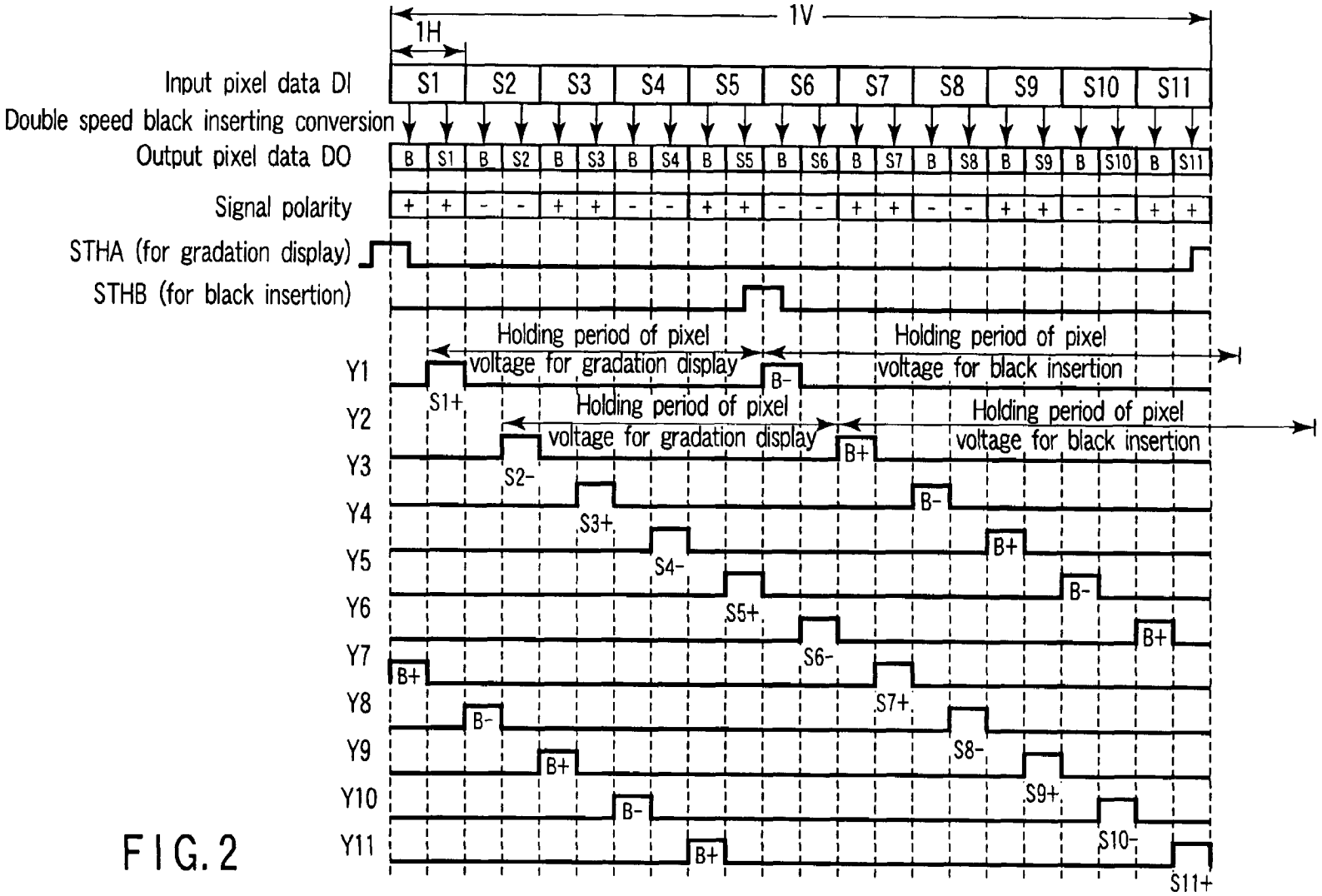
FIG. 2 is a time chart that illustrates the operation of the liquid crystal display device shown in FIG. 1 in a case where black insertion driving is executed at a 2× (double) vertical scanning speed.
Figure 3:
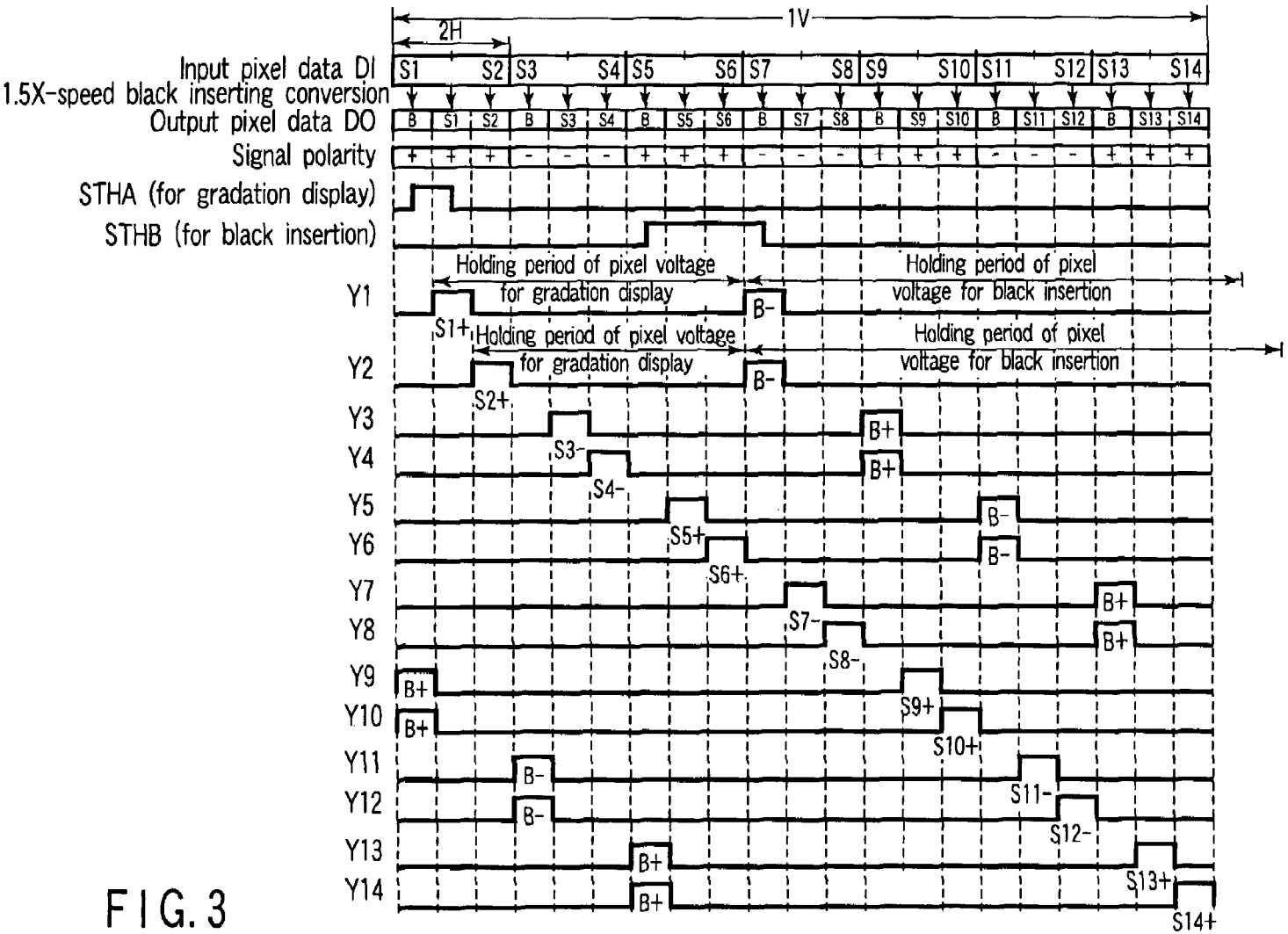
FIG. 3 is a time chart that illustrates the operation of the liquid crystal display device shown in FIG. 1 in a case where black insertion driving is executed at a 1.5× vertical scanning speed.

The operation of the liquid crystal display device shown in FIG. 1 is described referring to FIG. 2 and FIG. 3. In FIGS. 2 and 3, symbol B represents pixel data for black insertion, which is common to the pixels PX of the respective rows, and S1, S2, S3, . . . , designate pixel data for gradation display, which are associated with pixels PX on the first row, pixels PX on the second row, pixels PX on the third row, etc. Symbols + and − represent signal polarities at a time when the pixel data B, S1, S2, S3, . . . , are converted to pixel voltages Vs and output from the source driver XD.

FIG. 2 illustrates the operation of the liquid crystal display device in a case where black insertion driving is executed at a double (2×) vertical scanning speed. Each of the first start signal STHA and second start signal STHB is a pulse that is input to the gate driver YD with a pulse width corresponding to an H/2 period. The first start signal STHA is first input, and the second start signal STHB is input with a delay from the first start signal STHA in accordance with a ratio between a holding period of the pixel voltage for gradation display and a holding period of the pixel voltage for black insertion, that is, a black insertion ratio.

The gate driver YD shifts the first start signal STHA to select the gate lines Y1 to Ym one by one in every 1 horizontal scan period H and outputs a driving signal to the gate line Y1, Y2, Y3, . . . , in the second half of the 1H period. On the other hand, the source driver XD converts each of the gradation display pixel data S1, S2, S3, . . . , to the pixel voltages Vs in the second half of the associated 1H period, and outputs the pixel voltages Vs to the source lines X1 to Xn in parallel, with the polarity that is reversed in every 1H. The pixel voltages Vs are supplied to the liquid crystal pixels PX on the first row, the liquid crystal pixels PX on the second row, the liquid crystal pixels PX on the third row, the liquid crystal pixels PX on the fourth row, . . . , while each of the gate lines Y1 to Ym is driven in the second half of the associated 1H period.

In addition, the gate driver YD shifts the second start signal STHB to select the plural gate lines Y1 to Ym one by one in every 1 horizontal scan period H, and outputs a driving signal to the gate line Y1, Y2, Y3, . . . , in the first half of the 1H period. On the other hand, the source driver XD converts each of the black-insertion pixel data B, B, B, . . . , to the pixel voltages Vs in the first half of the associated 1H period, and outputs the pixel voltages Vs to the source lines X1 to Xn in parallel, with the polarity that is reversed in every 1H. The pixel voltages Vs are supplied to the liquid crystal pixels PX on the first row, the liquid crystal pixels PX on the second row, the liquid crystal pixels PX on the third row, while each of the gate lines Y1 to Ym is driven in the first half of the associated 1H period. In FIG. 2, the first start signal STHA and second start signal STHB are input with a relatively short interval. Actually, the first start signal STHA and second start signal STHB are input with a relatively long interval so that the ratio of the holding period of the pixel voltage for black insertion to the holding period of the pixel voltage for gradation display may agree with a black insertion ratio. In addition, black insertion for the pixels PX near the last row is continuous from the preceding frame, for example, as shown in the lower left part of FIG. 2.

In the case where black insertion driving is performed at a 1.5× vertical scanning speed, the image data converting circuit 13 is configured to execute 1.5×-speed black inserting conversion for image data that is input from the external signal source SS. In addition, the source driver XD is configured to output to the source lines X1 to Xn the pixel voltages Vs whose polarity is reversed, relative to the common voltage Vcom, so as to execute 2-line-unit reversal driving and frame-reversal driving (2H1V reversal driving). In the 1.5×-speed black inserting conversion, input pixel data DI for two rows is converted to pixel data B for black insertion for one row and pixel data S for gradation display for two rows, which become output pixel data DO, in every 2H period. The pixel data S for gradation display has the same gradation value as the pixel data DI, and the pixel data B for black insertion has the gradation value for black insertion. Each of the pixel data B for black insertion for one row and pixel data S for gradation display for two rows is serially output from the image data converting circuit 13 in every 2H/3 period.

FIG. 3 illustrates the operation of the liquid crystal display device in a case where black insertion driving is executed at a 1.5× vertical scanning speed. The first start signal STHA is a pulse that is input to the gate driver YD with a pulse width corresponding to a 2H/3 period, and the second start signal STHB is a pulse that is input to the gate driver YD with a pulse width corresponding to a 2H period. The first start signal STHA is first input, and the second start signal STHB is input with a delay from the first start signal STHA in accordance with a ratio between a holding period of the pixel voltage for gradation display and a holding period of the pixel voltage for black insertion, that is, a black insertion ratio.

The gate driver YD shifts the first start signal STHA to sequentially select the gate lines Y1 to Ym in units of two in every 2H period, and outputs driving signals to the gate line Y1, Y2, Y3, Y4, . . . , in the second and third 2H/3 periods that are included in the associated 2H period. On the other hand, the source driver XD converts each of the gradation display pixel data S1, S2, S3, S4, . . . , to the pixel voltages Vs in the second and third 2H/3 periods that are included in the associated 2H period, and outputs the pixel voltages Vs to the source lines X1 to Xn in parallel, with the polarity that is reversed in every 2H period. The pixel voltages Vs are supplied to the liquid crystal pixels PX on the first row, the liquid crystal pixels PX on the second row, the liquid crystal pixels PX on the third row, the liquid crystal pixels PX on the fourth row, . . . , while each of the gate lines Y1 to Ym is driven in the second and third 2H/3 periods that are included in the associated 2H period.

In addition, the gate driver YD shifts the second start signal STHB to select the gate lines Y1 to Ym in units of two in every 2H period, and outputs driving signals to the gate line Y1, Y2, Y3, Y4, . . . , in the first 2H/3 period that is included in the associated 2H period. On the other hand, the source driver XD converts each of the black-insertion pixel data B, B, B, . . . , to the pixel voltages Vs in the first 2H/3 period that is included in the associated 2H period, and outputs the pixel voltages Vs to the source lines X1 to Xn in parallel, with the polarity that is reversed in every 2H. The pixel voltages Vs are supplied to the liquid crystal pixels PX on the first row, the liquid crystal pixels PX on the second row, the liquid crystal pixels PX on the third row, the liquid crystal pixels PX on the fourth row, . . . , while each of the gate lines Y1 to Ym is driven in the first 2H/3 period that is included in the associated 2H period. In FIG. 3, the first start signal STHA and second start signal STHB are input with a relatively short interval. Actually, the first start signal STHA and second start signal STHB are input with a relatively long interval so that the ratio of the holding period of the pixel voltage for black insertion to the holding period of the pixel voltage gradation display may agree with a black insertion ratio. In addition, black insertion for the pixels PX near the last row is continuous from the preceding frame, for example, as shown in the lower left part of FIG. 3.

Figure 4:
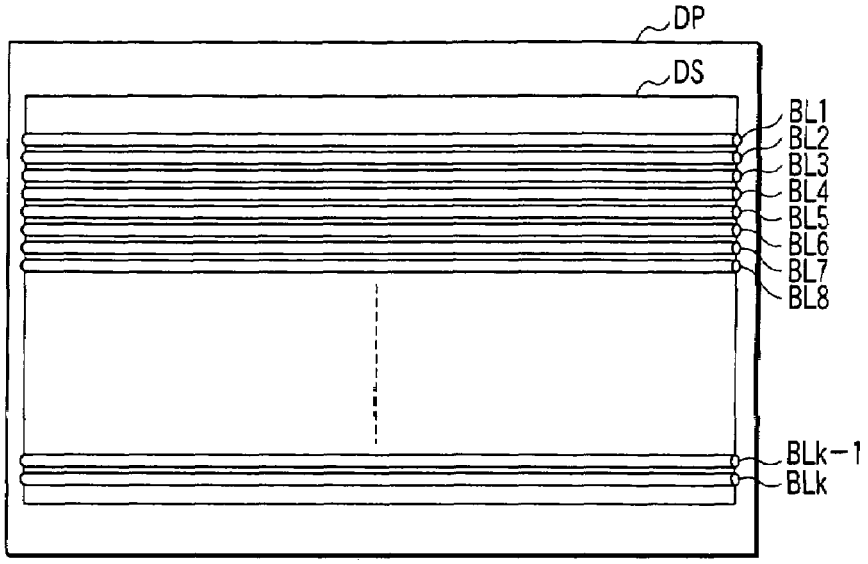
FIG. 4 illustrates the relationship between a backlight and a display panel, which are shown in FIG. 1.

FIG. 4 shows the relationship between the backlight BL and display panel DP shown in FIG. 1. A display screen DS shown in FIG. 4 is composed of the OCB liquid crystal pixels PX arrayed in a matrix. The backlight BL comprises, e.g. a k-number of backlight sources BL1 to BLk, which are arranged with a predetermined pitch in parallel to the rows of OCB liquid crystal pixels PX on the back side of the display panel DP. The backlight sources BL1 to BLk principally illuminate display areas obtained by equally dividing the screen DS in the vertical direction. Each of the backlight sources BL1 to BLk is composed of a single cold-cathode fluorescent tube, and illuminates one display area that comprises liquid crystal pixels PX of about 30 rows.

Figure 5:
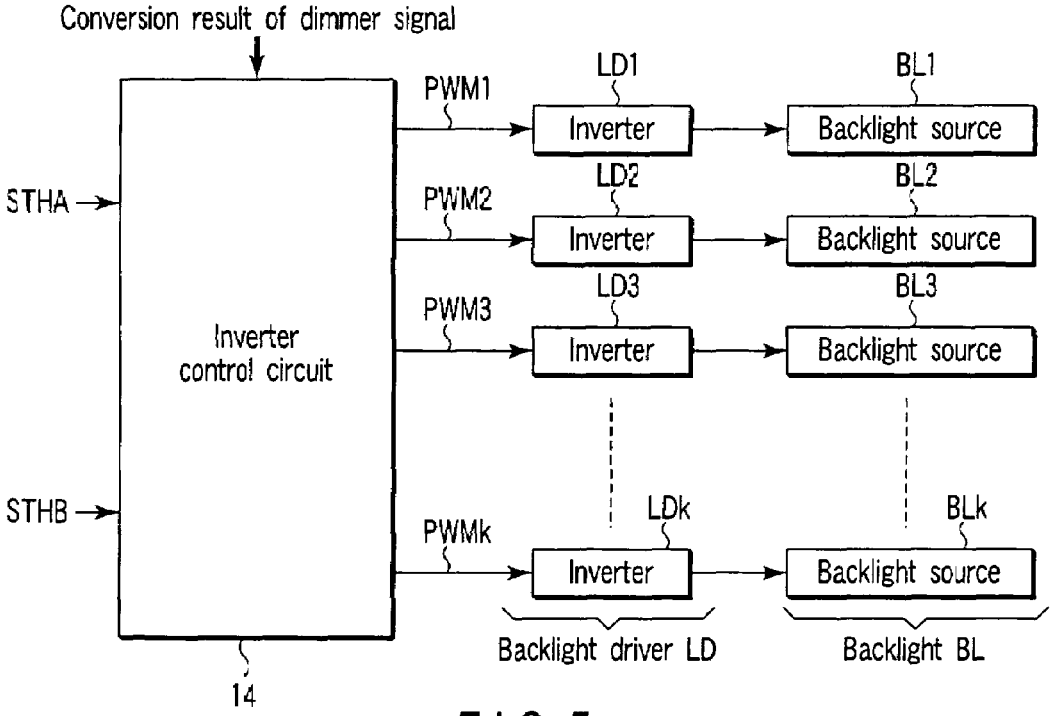
FIG. 5 shows, in greater detail, the circuit structures of an inverter control circuit, a backlight driver, and the backlight, which are shown in FIG. 1.
Figure 6:
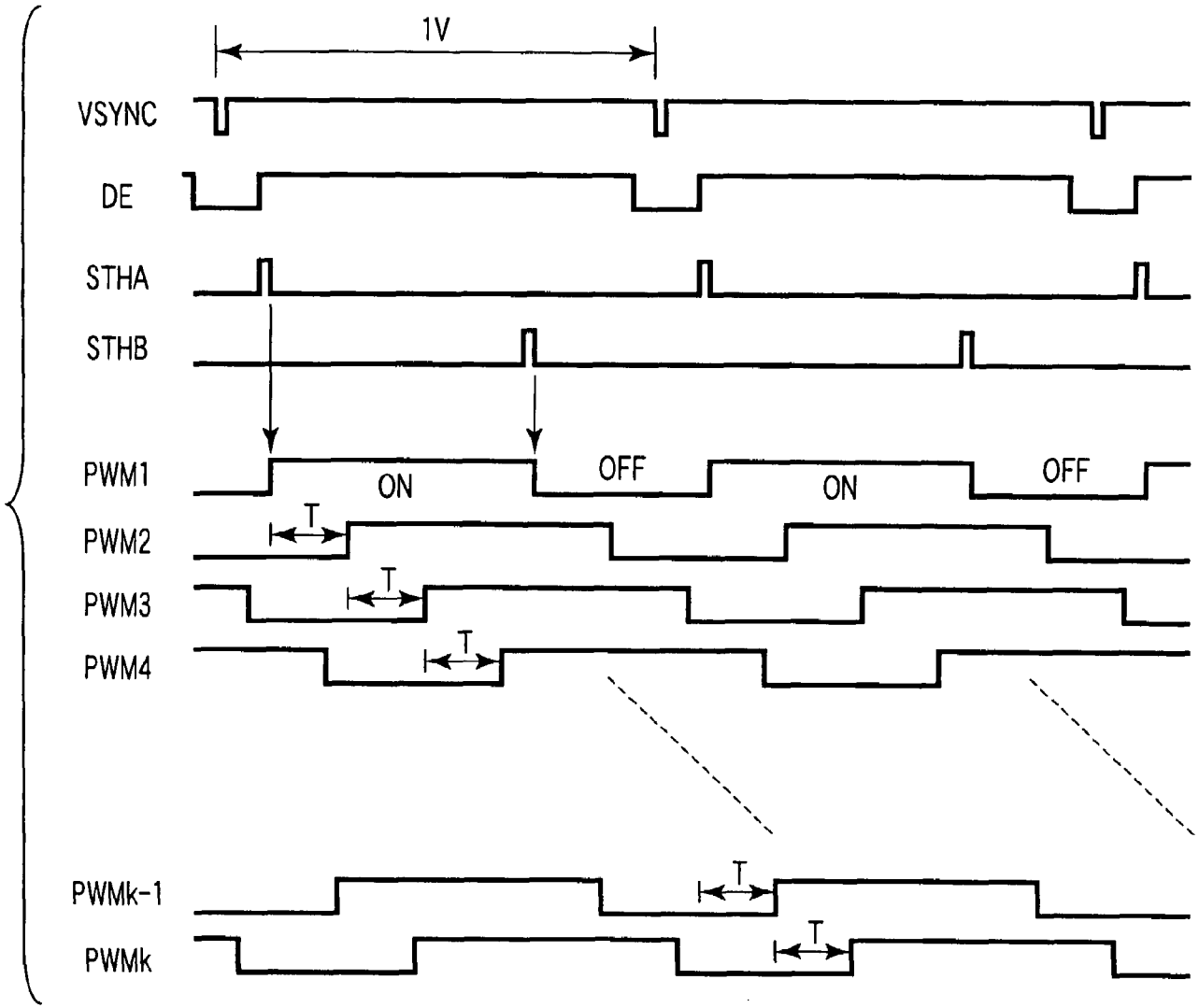
FIG. 6 is a time chart that illustrates the operation of the inverter control circuit shown in FIG. 5.

FIG. 5 shows in greater detail the circuit configuration of the inverter control circuit 14, backlight driver LD and backlight BL, which are shown in FIG. 1. FIG. 6 illustrates the operation of the inverter control circuit 14 that sets the luminance of the backlight BL at 100% on average. The inverter control circuit 14 controls the backlight driver LD so as to start, in synchronism with the first start signal STHA, the operation for sequentially blinking the backlight sources BL1 to BLk with a predetermined duty ratio. The backlight driver LD comprises a k-number of inverters LD1 to LDk that generate driving voltages for the backlight sources BL1 to BLk. The inverter control circuit 14 generates a k-number of pulse width modulation signals PWM (PWM1 to PWMk) shown in FIG. 5, to control the inverters LD1 to LDk.

The pulse width modulation signal PWM1 is generated by using the first start signals STHA, which is output from the vertical timing control circuit 11 as the control signal CTX, like the second start signal STHB. The first start signal STHA defines a reference timing at which the pixel voltages for gradation display are held in the liquid crystal pixels PX of the first row, and the second start signal STHB defines a reference timing at which the pixel voltages for black insertion are held in the liquid crystal pixels PX of the first row. Specifically, the holding period of the pixel voltage for gradation display is substantially equal to a period from the input of the first start signal STHA to the input of the second start signal STHB. The holding period of the pixel voltage for black insertion is substantially equal to a period from the input of the second start signal STHB to the input of the next first start signal STHA.

In the case where the brightness, i.e. luminance, of the display panel DP is set at 100%, the duty ratio of each of the light sources BL1 to BLk is determined to be substantially equal to a ratio of a holding period of the pixel voltage for gradation display to a sum of the holding period of the pixel voltage for gradation display and a holding period of the pixel voltage for black insertion. The inverter control circuit 14 raises the pulse width modulation signal PWM1 to a high level by detecting the transition of the start signal STHA (i.e. the leading edge or trailing edge of the pulse), and lowers the pulse width modulation signal PWM1 after the passing of a predetermined period, which corresponds to the holding period of the pixel voltage for gradation display, from the rising of the pulse width modulation signal PWM1. For example, a counter that counts clock pulses is provided, and the counting of clock pulses is started from the transition timing of the start signal STHA. At a timing when a preset count value is reached, the pulse width modulation signal PWM1 is lowered.

Thereby, the pulse width modulation signal PWM1 has a predetermined duty ratio corresponding to the ratio of the holding period of the pixel voltage for gradation display to the sum of the holding period of the pixel voltage for gradation display and the holding period of the pixel voltage for black insertion. The pulse width modulation signals PWM2 to PWMk can be obtained by delaying the pulse width modulation signal PWM1, and are displaced by a phase difference T, relative to the pulse width modulation signals PWM1 to PWMk-1, as shown in FIG. 6. The phase difference T is determined in accordance with the pitch of the backlight sources BL1 to BLk. The inverters LD1 to LDk convert the pulse width modulation signals PWM1 to PWMk from the inverter control circuit 14 to driving voltages, and output the driving voltages to the backlight sources BL1 to BLk. The backlight sources BL1 to BLk are turned on when the pulse width modulation signals PWM1 to PWMk are at high level, and are turned off when the pulse width modulation signals PWM1 to PWMk are at low level.

The pulse width modulation signal PWM1 may not necessarily transition at the same time as the start signal STHA, and a predetermined offset time may be provided. In this case, the offset time is determined on the basis of the number of rows of liquid crystal pixels PX that constitute each display area.

It is possible to adopt a method in which the sync signal VSYNC, DE, etc., which is supplied from the outside, is used as the reference of the transition timing of the pulse width modulation signal PWM1. However, the method of using the start signal STHA can achieve a high precision in overlapping the turn-on and turn-off periods of each of the backlight sources BL1 to BLk with the periods of holding the pixel voltage for gradation display and the pixel voltage for black insertion in the liquid crystal pixels PX located within the associated display area.

FIG. 6 shows the case where the luminance of the display panel DP is set at 100%. However, the controller circuit 5, as shown in FIG. 1, further comprises a dimmer signal converting circuit 15 that converts a dimmer signal DIM from the external signal source SS so as to represent a duty ratio that is not greater than the ratio of the holding period of the pixel voltage for gradation display to the sum of the holding period of the pixel voltage for gradation display and the holding period of the pixel voltage for black insertion. The dimmer signal DIM is a pulse width modulation signal of a variable duty ratio. The dimmer signal converting circuit 15 is configured to detect the duty ratio of the dimmer signal DIM as a numerical value, and to output a conversion result that is obtained by converting the numerical value using a conversion table TB.

FIG. 7 shows an example of the conversion table TB for a black insertion ratio of 20%, which is incorporated in the dimmer signal converting circuit 15, and FIG. 8 shows an example of the conversion table TB for a black insertion ratio of 50%, which is incorporated in the dimmer signal converting circuit 15. In the case where the black insertion ratio is 20%, the conversion table TB shown in FIG. 7 is used to convert input values of the duty ratio, 100%, 80%, 60%, 40%, to output values of the duty ratio, 80%, 55%, 40% and 25%. Specifically, the content of the conversion table TB for the black insertion ratio of 20% is set such that the output value has a proportional relation to the input value, without exceeding the ratio of the holding period of the pixel voltage for gradation display to the sum of the holding period of the pixel voltage for gradation display and the holding period of the pixel voltage for black insertion, which is obtained at the black insertion ratio=20%. On the other hand, in the case where the black insertion ratio is 50%, the conversion table TB shown in FIG. 8 is used to convert input values of the duty ratio, 100%, 80%, 60%, 40%, to output values of the duty ratio, 50%, 40%, 30% and 20%. Specifically, the content of the conversion table TB for the black insertion ratio of 50% is set such that the output value has a proportional relation to the input value, without exceeding the ratio of the holding period of the pixel voltage for gradation display to the sum of the holding period of the pixel voltage for gradation display and the holding period of the pixel voltage for black insertion, which is obtained at the black insertion ratio=50%.

Figure 9:
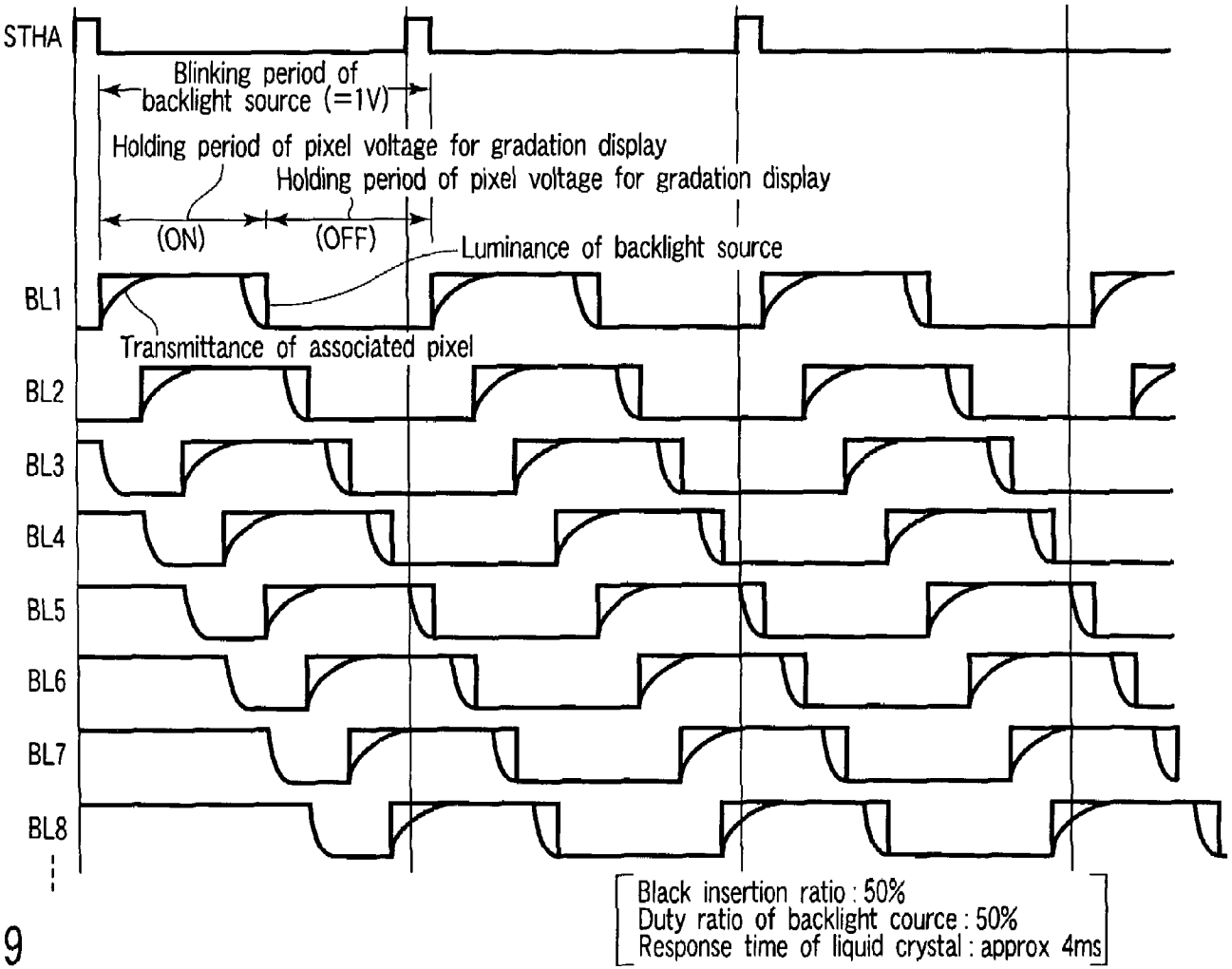
FIG. 9 shows a relationship between the luminance of backlight sources shown in FIG. 4, and the transmittance of associated liquid crystal pixels.

FIG. 9 shows a relationship between the luminance of the backlight sources BL1, BL2, BL3, . . . , and the transmittance of associated pixels PX. If the duty ratio of the dimmer signal DIM is 100%, the turn-on period of the backlight source BL1, BL2, BL3, . . . , coincides with the holding period of the pixel voltage for gradation display in the associated liquid crystal pixel PX, as shown in FIG. 9. The turn-on period becomes shorter by decreasing the duty ratio of the dimmer signal DIM. In the meantime, the transmittance of the liquid crystal pixel PX varies with a delay, as shown in FIG. 9, depending on a liquid crystal response time. It is thus preferable to set the content of the conversion table TB in consideration of the liquid crystal response time. FIG. 9 omits depiction of a response time of the backlight source BL1, BL2, BL3, . . . . Actually, in general, the backlight source BL1, BL2, BL3, . . . , responds with a delay from the liquid crystal. It is thus more preferable to set the content of the conversion table TB in consideration of the response time of the backlight source BL1, BL2, BL3, . . . .

In the liquid crystal display device of the present embodiment, the operation for sequentially blinking the backlight sources BL1 to BLk with a predetermined duty ratio is started in synchronism with the gradation display start signal STHA. The predetermined ratio is determined in accordance with the dimmer signal DIM from the outside such that the predetermined duty ratio, at its maximum value, is not greater than the ratio of the holding period of the pixel voltage for gradation display to the sum of the holding period of the pixel voltage for gradation display and the holding period of the pixel voltage for black insertion. It is thus possible to vary the turn-on period of each backlight source, BL1 to BLk, within the range of the holding period of the pixel voltage for gradation display in the associated OCB liquid crystal pixel PX. Therefore, it is possible to prevent the following problem: an illumination period, which is necessary for obtaining a target brightness, cannot be secured due to turn-off of the backlight source, BL1 to BLk, during the holding period of the pixel voltage for gradation display, or a non-illumination period, which is necessary for obtaining a target brightness, cannot be secured due to turn-on of the backlight source, BL1 to BLk, during the holding period of the pixel voltage for black insertion. Hence, in the blink-driving of the backlight BL, the brightness of the display panel DP can be varied in a linear fashion in relation to the dimmer signal DIM from the outside.

The present invention is not limited to the above-described embodiment, and various modifications can be made without departing from the spirit of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display control circuit for a display panel in which a plurality of liquid crystal pixels are arrayed substantially in a matrix, comprising:

a timing control circuit that generates a start signal for gradation display and a start signal for non-gradation display;

a panel driving unit that sequentially drives the liquid crystal pixels in units of one row under the control of the start signal for gradation display to hold pixel voltages for gradation display in the liquid crystal pixels of the driven row, and that sequentially drives the liquid crystal pixels in units of at least one row under the control of the start signal for non-gradation display to hold pixel voltages for non-gradation display in the liquid crystal pixels of the driven row; and a light source driving unit that drives a plurality of backlight sources arranged substantially in parallel to the rows of liquid crystal pixels;

wherein the light source driving unit is configured to start, in synchronism with the start signal for gradation display, an operation for sequentially blinking the backlight sources with a predetermined duty ratio, and the predetermined duty ratio is determined in accordance with a dimmer signal from outside such that the predetermined duty ratio, at a maximum value thereof, is not greater than a ratio of a holding period of the pixel voltage for gradation display to a sum of the holding period of the pixel voltage for gradation display and a holding period of the pixel voltage for non-gradation display, and wherein the light source driving unit includes a plurality of voltage conversion inverters that generate driving voltage for the backlight sources, a dimmer signal converting circuit that converts the dimmer signal from the outside such that the dimmer signal represents a duty ratio that is not greater than the ratio of the holding period of the pixel voltage for gradation display to the sum of the holding period of the pixel voltage for gradation display and the holding period of the pixel voltage for non-gradation display, and an inverter control circuit that generates, in response to the start signal for gradation display, a pulse width modulation signal with a duty ratio corresponding to a conversion result of the dimmer signal converting circuit, and outputs the pulse width modulation signal to the voltage conversion inverters with a phase difference corresponding to a pitch of the backlight sources.

2. The display control circuit according to claim 1, wherein the dimmer signal from the outside is a pulse width modulation signal of a variable duty ratio, and the dimmer signal converting circuit is configured to detect the duty ratio of the dimmer signal from the outside as a numerical value and to output a conversion result that is obtained by converting the numerical value using a conversion table.

3. The display control circuit according to claim 2, wherein the conversion table is set to have different contents in association with a non-gradation display ratio that is the ratio of the holding period of the pixel voltage for non-gradation display to the holding period of the pixel voltage for gradation display.

* * * * *